US006664514B1

(12) United States Patent
Marshall

(10) Patent No.: US 6,664,514 B1
(45) Date of Patent: Dec. 16, 2003

(54) IGNITER SHOCK MOUNTING DEVICE AND METHODS RELATED THERETO

(75) Inventor: Alan E. Marshall, Merrimack, NH (US)

(73) Assignee: Saint-Gobain Ceramics & Plastics, Inc., Worcester, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/612,893

(22) Filed: Jul. 10, 2000

(51) Int. Cl.[7] ..... H05B 3/00; F23Q 7/00
(52) U.S. Cl. ..... 219/267; 219/551; 361/264
(58) Field of Search ..... 219/267, 270, 219/260, 542, 546, 548, 551, 552, 553; 338/315, 280–281; 361/264–266; 431/258–259, 263, 264, 265

(56) References Cited

U.S. PATENT DOCUMENTS

| | | | | | |
|---|---|---|---|---|---|
| 1,505,762 | A | * | 8/1924 | Barnard | 219/260 |
| 2,625,990 | A | * | 1/1953 | Smith | 219/260 |
| 2,912,623 | A | * | 11/1959 | Tuttle | 219/267 |
| 2,920,243 | A | * | 1/1960 | Taren | 219/267 |
| 3,562,590 | A | * | 2/1971 | Mitts et al. | 219/270 |
| 4,406,941 | A | * | 9/1983 | Schmerein, Jr. | 219/261 |
| 4,462,790 | A | * | 7/1984 | Hansen et al. | 431/264 |
| 4,464,107 | A | * | 8/1984 | Boe | 431/264 |

FOREIGN PATENT DOCUMENTS

| | | | | |
|---|---|---|---|---|
| FR | 926177 | * | 9/1947 | 219/260 |
| GB | 2083187 | * | 3/1982 | |
| GB | 2089012 | * | 6/1982 | |
| SE | 206513 | * | 8/1966 | 219/546 |

* cited by examiner

*Primary Examiner*—John A. Jeffery
(74) *Attorney, Agent, or Firm*—Peter F. Corless; William J. Daley, Jr.; Edwards & Angell, LLP

(57) ABSTRACT

Featured is a method for securing an ignition device to a support. The securing method includes disposing a shock mounting pad between the ignition device and the support, the shock mounting pad being configured so as to reduce external loads to the ignition device, more particularly to reduce external loads being applied in one of directions transverse to a long axis of a heating element of the ignition device and more specifically, to reduce external impact loads. The shock mounting pad is made of a material having a thickness and firmness so as to be capable of reducing external loads being applied in one of a horizontal or vertical direction with respect to a long axis of a heating element forming a part of the ignition device. In this way, the structure formed by the combination of the ignition device, shock mounting pad and the support is more resistant to applied external loads than a case in which the ignition device is secured without the shock mounting pad. Also featured are a method for improving the shock resistance of an ignition device being secured to a support, a shock mounting device to reduce communication of external loads to the ignition device and heat generating apparatuses embodying such methodologies.

42 Claims, 3 Drawing Sheets

IGNITER SHOCK MOUNTING DEVICE AND METHODS RELATED THERETO

FIELD OF INVENTION

The present invention relates to a shock mounting device for hot surface igniters and related methods and more particularly to a shock mount washer/ pad for silicon carbide hot surface igniters.

BACKGROUND OF THE INVENTION

There are a number of appliances such as cooking ranges and clothes dryers and heating apparatuses such as boilers and furnaces in which a combustible material, such as a combustible hydrocarbon (e.g., propane, natural gas, oil) is mixed with air (i.e., oxygen) and continuously combusted within the appliance or heating apparatus so as to provide a continuous source of heat energy. This continuous source of heat energy is used for example to cook food, heat water to supply a source of running hot water and heat air or water to heat a structure such as a house.

Because this mixture of fuel and air (i.e., fuel/air mixture) does not self-ignite when mixed together, an ignition source must be provided to initiate the combustion process and to continue operating until the combustion process is self-sustaining. In the not too distant past, the ignition source was what was commonly referred to as a pilot light in which a very small quantity of the combustible material and air was mixed and continuously combusted even while the heating apparatus or appliance was not in operation. For a number of reasons, the use of a pilot light as an ignition source was done away with and an igniter used instead. An igniter is a device that creates the conditions required for ignition of the fuel/air mixture on demand, including piezoelectric igniters and silicon carbide hot surface igniters.

With hot surface igniters, such as the silicon carbide hot surface igniter, the heating tip or element is heated by electricity to the temperature required for the ignition of the fuel/air mixture, thus when the fuel/air mixture flows proximal to the igniter it is ignited. After a continuous combustion process is established, the electricity to the igniter element is typically turned off or discontinued. This process is repeated as and when needed to meet the particular operating requirements for the heating apparatus/appliance.

In use, it has been found that a percentage of heating apparatuses and appliances failed to operate or operate as intended because the igniters or the heating element thereof failed to generate the temperature required for ignition. Some of these failures occurred as a result of external loads, such as external impact loads, imposed on the igniter and/or igniter element during the manufacturing process, during shipping and handling, or during installation. While the impact loads were sufficient to fail the igniter or igniter element, such impact loads did not necessarily result in noticeable damage to the appliance or heating apparatus. Consequently, the failed igniter/igniter element typically remained undiscovered until after the appliance/heating apparatus had been installed and put to use.

The failures of the heating element typically manifested themselves as cracks in the element. These cracks, however, did not always manifest themselves as a complete crack through the element (i.e., through crack). Rather, in a number of cases the impact load caused the heating element to form a partial crack in the element. After a period of time, the cyclical heating of the element caused this partial crack to propagate until it caused the ignition element to essentially fail electrically (e.g., became a through crack or form an open). Consequently, the heating element functioned as intended for a period of time and then failed typically rendering the heating apparatus completely inoperable or rendering the appliance completely or partially inoperable. Tests by Applicants have shown that these partial cracks can lead to a failure over a wide range of times from a matter of minutes to hundreds of hours of operation.

Because a number of these igniter/heating element failures occurred during the warranty period for the appliance or heating apparatus, the manufacturer bore the cost for sending a repair person out to make a service call to determine the cause for the failure and to replace the failed igniter. Such service calls are expensive to the manufacturer and for a heating apparatus the service call can prove to be even more expensive because the service call usually cannot be delayed for a more convenient and less costly time. If the failure did not occur during the warranty period, then the service call was at the expense of the consumer. In addition to the expense, the failure of an appliance or heating apparatus irritates and annoys consumers because of the failure itself and because of the inconvenience of having to be available so the service person can make the service call. This irritation and annoyance can lead to the product getting a bad reputation for quality.

As such, the failures of igniters and/or the heating elements thereof is a particularly important concern of the manufacturer. Consequently, there is a continuing desire to reduce the number of failures and thereby reduce the number of warranty service calls and the annoyance to consumers. It thus would be desirable to provide a method and device that would make an igniter, in particular a hot surface igniter, more resistant to the external shock or impact loads that can occur during manufacturing, shipping and handling, and/or installation. It would be particularly desirable to provide such a device and method that would make an igniter more resistant to external shock or impact loads causing failure of prior art igniters. It also would be desirable to provide such a device that would be easy to install and that would not require a major modification to the mounting technique for the igniter or a change in the design of the appliance or heating apparatus. It also would be desirable to provide a heating apparatus or appliance that would be less costly for service repairs as compared to prior art heating apparatuses or appliances. The shock mounting device preferably would be simple in construction and the related methods would not require highly skilled users to install or utilize the device.

SUMMARY OF THE INVENTION

The present invention features methods and devices that reduce the external loads, in particular the external impact loads, that can be applied to an ignition device that is secured within a heating apparatus or an appliance. This ignition device is secured therein to a metal bracket or structural frame of the heating apparatus or appliance or it is secured to a burner tube provided therein. The external loads being particularly reduced are those being applied in one of the directions transverse to a long axis of a heating element of the ignition device.

In one aspect of the present invention there is featured a method for securing an ignition device to a support, which method includes disposing a shock mounting pad between a portion of the ignition device and a portion of the support. The shock mounting pad is configured and arranged so as to reduce external impact loads being applied to the ignition device as compared to the case where there is no shock mounting pad. In an exemplary embodiment, the external loads being reduced are those which would be applied to the ignition device, in particular the hearing element thereof, in one of the directions transverse to the long axis of a heating element.

The ignition device also is configurable so as to include a mounting mechanism (e.g., a mounting bracket) by which the ignition device is secured or attached to the support of the heating apparatus or appliance. In such a case the shock mounting pad is disposed between a portion of the mounting mechanism and at least a portion of the support.

Also featured is a method for improving the shock resistance of an ignition device to be attached to a support of a heating apparatus or an appliance. This method includes providing a shock mounting pad and securing the ignition device to the support such that the provided shock mounting pad is disposed between at least a portion of the ignition device and the support. The shock mounting pad being provided is configured and arranged so as to reduce external impact loads to the ignition device when it is secured to the support. As indicated above, the ignition device can further include a mounting mechanism and said securing can further include securing the mounting mechanism to the support such that the provided shock mounting pad is disposed between at least a portion of the mounting bracket and the support.

In another aspect of the present invention there is featured a shock mounting device for an ignition device secured to a support of a heating apparatus or an appliance. The shock mounting device includes a pad that is configured so as to be disposed between a surface of the support and at least a part of the ignition device. The pad also is configured and arranged so as to reduce communication of external impact loads, that could be applied, to the ignition device.

In particular embodiments, the above-described pad or shock mounting pad is generally made of a material having a thickness and firmness such that when the pad is disposed between an ignition device and the support it is secured to, the resultant structure is more resistant to external impact loads applied to the so-secured ignition device than the case where the ignition device is secured directly to the support without such a pad. The material comprising. the pad/shock-mounting pad also shall generally be any of a number of materials known in the art that are appropriate for the environment (e.g., temperature, pressure, humidity conditions) of the intended use as well as the intended function.

In more particular embodiments, the material, thickness and firmness of such a pad is selected so that the ignition device can resist an external load applied in one of a horizontal or vertical direction to a long axis of the heating element forming a part of the ignition device. In preferred embodiments, the material, thickness and firmness of such a pad also is selected so that the ignition device is capable of resisting an external impact load at least about 50 percent larger, more particularly a load at least about 2 times larger, and more specifically a load in the range of from about 1¾ to 3 times larger, on average than the average impact load that causes a failure of the ignition device without such a pad.

In specific embodiments, the pad has a thickness of at least about 0.030 inches, more specifically a thickness of at least about 0.0625 inches (1/16), more particularly a thickness of about 0.125 inches (1/8) and further a thickness in the range of from about 0.030 inches to about 0.125 inches. The materials comprising the pad include, but are not limited to ceramic fibers, fiberglass, viton rubber, rubber, metal, foam plastics such as a silicone foam, for example, a Poron® silicone foam manufactured by the Rogers Corporation with or without an adhesive material applied thereto.

The above-described pad or shock mounting pad is formed into any of a number of geometric configurations known to those skilled in the art, that would be appropriate for a given application. Such configurations include, but are not limited to polygons (e.g., squares, rectangles, hexagons, octagons) and arcuate shapes (e.g., discs, circular wafers, washers). Such a pad can be arranged so as to also include one or more apertures so as to be capable of receiving in the aperture the securing device (e.g., nut, screw, rivet, stud) used to attach or secure the ignition device to the support. Such a pad also can be arranged so as to form a continuous surface which is to be pierced by the securing device. The above-described pad or shock mounting pad can further include an adhesive material (e.g., acrylic adhesive, silicone adhesive) applied to a surface of such a pad so the pad can be secured to one of the support or ignition device to facilitate the placement of the pad between the support and ignition device. In exemplary embodiments, the above-described pad or shock mounting pad is made from a ceramic fiber and is configured in the form of a washer having a ½ inch outer diameter, a $1/8^{th}$ inch diameter through aperture and a thickness in the range of from about 0.0625 to 0.125 inches.

Also featured is a heating apparatus or an appliance including such a shock mounting device according to the present invention that reduces the communication of loads to the ignition device thereof, which loads are external impact loads being applied to the heating apparatus or appliance.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 1:
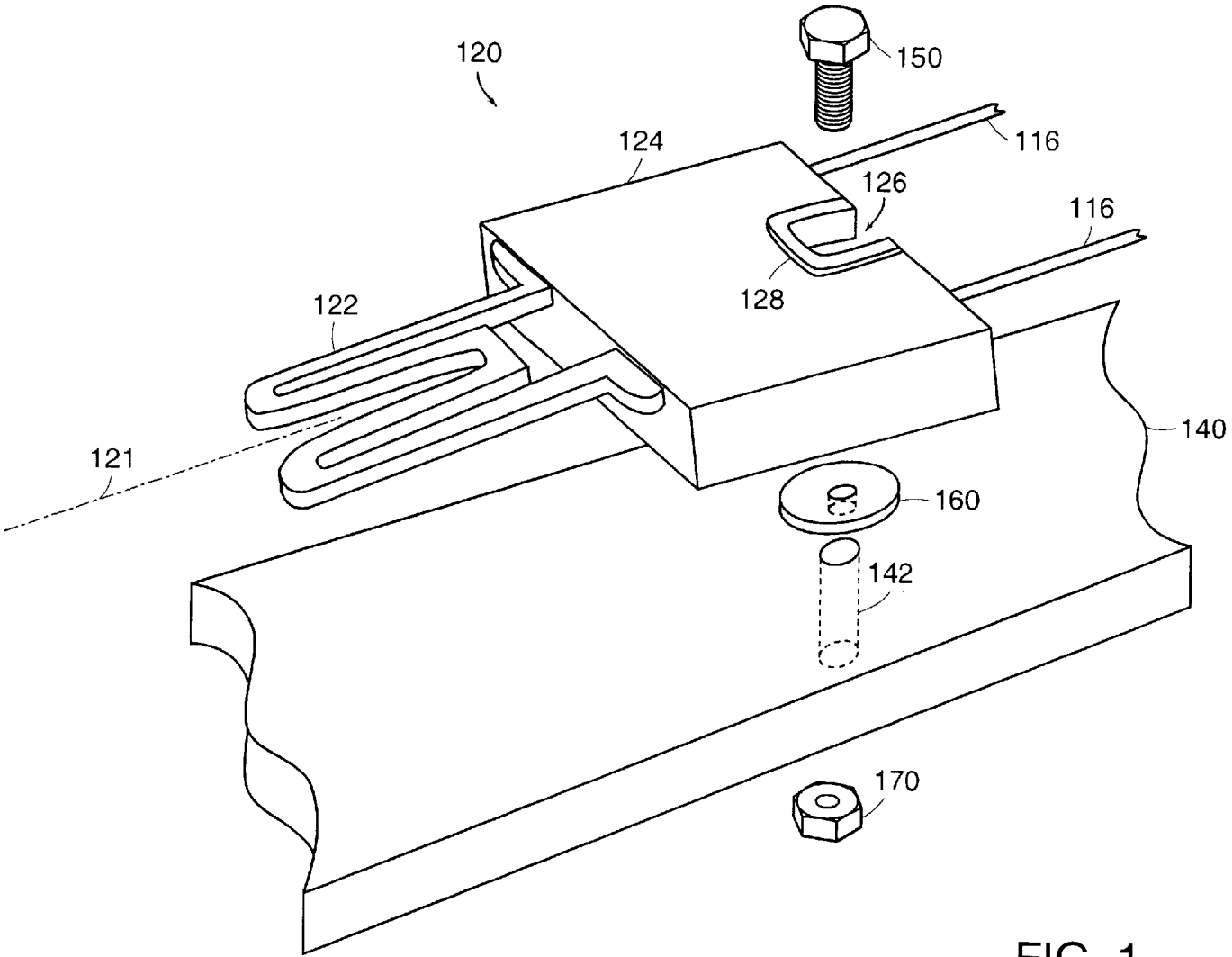
FIG. 1 is an exploded perspective view of an exemplary ignition device secured to a support of a heating apparatus or appliance support in accordance with the present invention.

Referring now to the various figures of the drawing wherein like reference characters refer to like parts, there is shown in FIG. 1, an exploded perspective view of an exemplary ignition device 120 that is secured to a support 140 of a heating device 100 (FIG. 3) in accordance with the present invention. In the illustrated embodiment, the ignition device 120 is a hot surface igniter type of ignition device, such as a silicon carbide hot surface igniter manufactured by St. Gobain Industrial Ceramics Norton Igniter Products.

Such an ignition device includes a heating element 122 that extends outwardly from an end of the base 124 which it is secured to.

Although one type of a hot surface igniter is illustrated in FIG. 1, it is within the scope of the present invention for the teachings of the present invention be adapted for use to secure other types of hot surface igniters as well as other types of ignition devices or igniters, such as for example Norton Mini Igniters®, Surface Igniters hot surface igniters, or $I^2R$ hot surface igniters, to the support of a heating device. In the present invention the term support is used to generally describe the member that the ignition device is being secured to so the ignition device can perform its intended ignition function. It. should be recognized, however, that the member performing the support function can be a burner tube through which the fuel or fuel/air mixture flows as well as a structural member of the heating. device designed to perform the support function.

Figure 3:
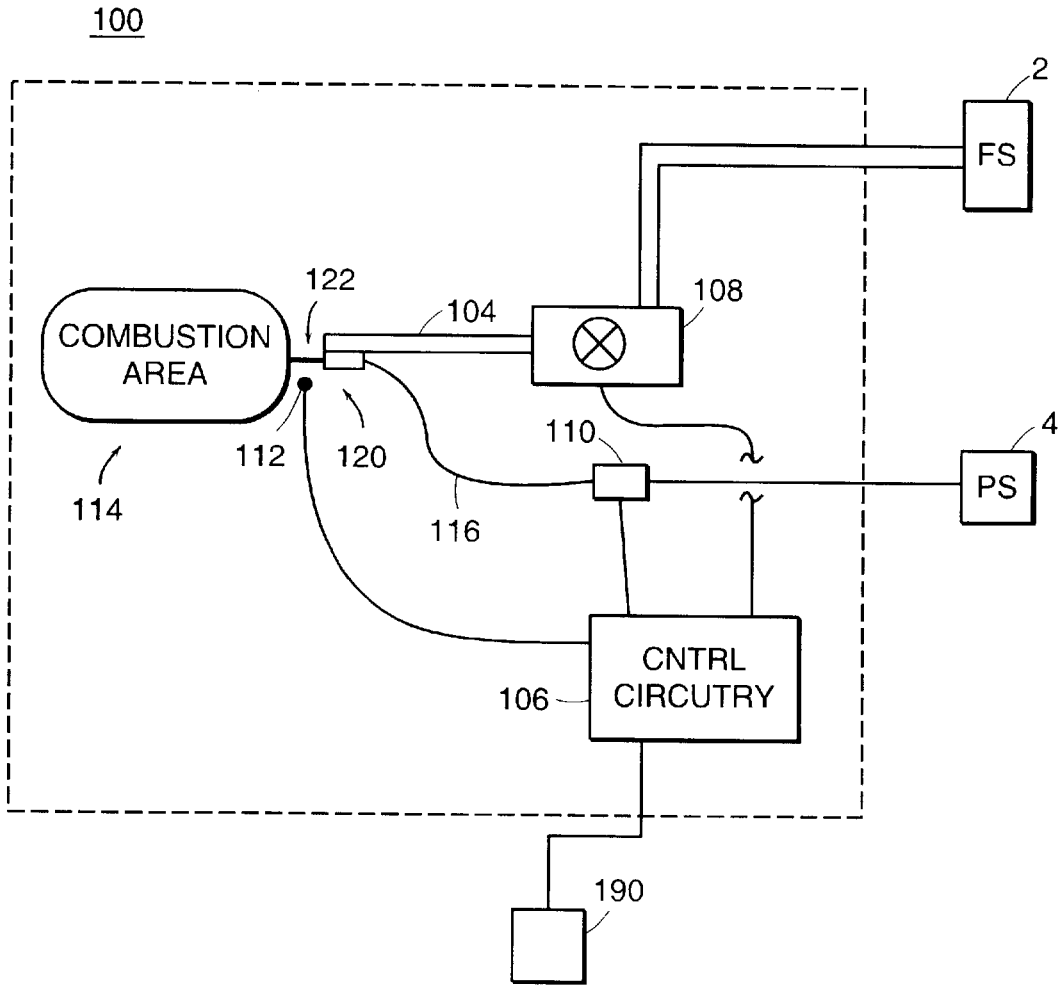
FIG. 3 is a simplified schematic view of an appliance or heating apparatus having an ignition device mounted to a support in accordance with methodology of the present invention.

The ends of the heating element 122 are disposed within the base 124. The ends of the heating element are electrically isolated from each other in the base and are electrically interconnected to the lines 116 extending therefrom. As explained further below in connection with FIG. 3, these lines 116 are selectively and electrically interconnected to an electrical power source 4 through an electrical power switch 110 (FIG. 3). As is known in the art, the heating element 122 of such hot surface igniters is heated to the desired temperature by passing an electrical current through the heating element, similar in principle to the electrical heating element for a conventional stove.

The base 124 of the ignition device 120 includes a slot 126 that extends between the top and bottom surfaces of the base so as to be in the form of a through aperture in the base. In the illustrated embodiment, the slot also extends lengthwise to the other end of the base 124, however, such a slot also can be arranged so as to form a circular through aperture in the base. The threaded end of a bolt 150 or screw is passed through the slot 126 and through a shock mounting pad 160 according to the present invention. The threaded end also is passed through an aperture 142 in the support 140 and threadably received in the threaded aperture of a nut 170. As is known in the art, the nut 170 and bolt 150 are tightened thereby securing the base 124 to the support with the shock mounting pad 160 disposed between the base and the support. In this way, the ignition device. 120 is directly secured to the support 140 of the heating device, which support as provided above (FIG. 3) can be the burner tube 104 of a heating device 100 (FIG. 3).

Although a nut and bolt type of connection is illustrated, this shall not constitute a limitation on the mechanism that secures the ignition device 120 to the support 140. For example, the aperture 142 in the support 140 can be a threaded aperture in which is threadably received the threaded end of the bolt 150. The bolt 150 also can be a well known self-tapping screw that can be screwed into a blind hole comprising the aperture 142 in the support. Also the support 140 can be configured with a stud that extends outwardly from the support. The base 126 can be secured to the stud using any of a number of techniques known to those skilled in the art. Such examples are illustrative of a few techniques for securing the base 124 to the support and thus shall not be construed as limiting the different ways in which the ignition device can be secured to the support.

As indicated above, the base 124 is secured to the support 140 so that the shock mounting pad 160 is disposed therebetween. The shock mounting pad 160, as described further hereinafter, is configured and arranged to make the ignition device 120 more resistant to external loads, such as external impact loads, occurring during manufacturing, shipping and handling or during installation of the heating device. In other words, a larger percentage of the external loads being applied to the ignition device 120 during manufacturing, shipping and handling or during installation of the heating device, in particular external impact loads, do not cause a failure of the ignition device as compared to the loads causing failures of the ignition device in conventional heating devices (i.e., ignition device that are secured to a support without a shock mounting pad).

The external loads or external impact loads of particular interest to the failure of the heating element of a hot surface igniter such as the heating element 122 of the ignition device 120 illustrated in FIG. 1, are those that can be applied in one of the directions transverse to a long axis 121 of the ignition device heating element. In the following, the horizontal direction shall be understood to mean a direction that is perpendicular to the long axis 121 generally cross wise to the heating element (e.g., parallel to the top and bottom surfaces of the base 124). Similarly, the vertical direction shall be understood to mean a direction that is perpendicular to the long axis 121 and perpendicular to the top and bottom surfaces of the heating element (e.g., generally perpendicular to the top and bottom surfaces of the base).

The shock mounting pad 160 is generally made of a material having a thickness and firmness such that when the pad is disposed between the ignition device 120 and the support 140 it is secured to, the resultant structure is more resistant to external impact loads applied to the so-secured ignition device than the case where the ignition device is secured directly to the support without a such a pad. The material comprising the shock-mounting pad also shall be any of a number of materials known in the art that are appropriate for the environment (e.g., temperature, humidity, pressure conditions) of the intended use as well as the intended function. Such materials include, but are not limited to ceramic fibers, fiberglass, viton rubber, rubber, metal, fiberglass insulation, foam plastics such as a silicone foam, for example, Poron® silicone foam as manufactured by the Rogers Corporation with or without an adhesive applied thereto.

In more particular embodiments, the material, thickness and firmness of such a pad is selected so that the ignition device resists an external load applied in one of a horizontal or vertical direction to the heating element long axis 121. Generally, the firmness and thickness of the material being chosen are considered in combination for a given application. More specifically, the material, thickness and firmness of such a pad is selected so that the ignition device is capable of resisting an external impact load at least about 50 percent larger, more particularly a load at least about 2 times larger, and more specifically a load in the range of from about 1¾ to 3 times larger, on average than the average impact load causing a failure in the case where the ignition device is secured to a support without such a pad. In specific embodiments, the pad has a thickness of at least about 0.030 inches, more specifically a thickness of at least about 0.0625 inches (1/16), more particularly a thickness of about 0.125 inches (1/8) and further a thickness in the range of from about 0.030 inches to about 0.125 inches.

In the illustrated embodiment, the shock mounting pad 160 is in the form of a washer having a through aperture in which is received the threaded portion of the bolt 150. This, however shall not constitute a limitation on the scope of the present invention as the shock mounting pad can be formed into any of a number of geometric configurations known to those skilled in the art, that would be appropriate for a given application. Such configurations include, but are not limited to polygons (e.g., squares, rectangles, hexagons, octagons) and arcuate shapes (e.g., discs, washers, circular wafers). As indicated above, such a pad can be arranged so as to also include one or more apertures therein so as to be capable of receiving in the aperture the securing device (e.g., nut, screw, rivet, stud) used to attach or secure the ignition device to the support. The shock mounting pad 160, however, can be formed so as to be continuous without a through aperture. In such a case at least a portion of the particular mechanism to secure the base 124 to the support 140 is configured to pierce and pass through the shock mounting pad (e.g., self-tapping screw). The above-described pad or shock mounting pad can further include an adhesive material (e.g., acrylic adhesive, silicone adhesive, etc.) that is applied to a surface of such a pad so the pad can be secured to one of the support or ignition device to facilitate the placement of the pad between the support and ignition device.

In the illustrated exemplary embodiment, the shock mounting pad 160 is made of a ceramic fiber and is formed in the shape of a washer, in particular a washer having a ½ inch outer diameter, a $\frac{1}{8}^{th}$ inch diameter through aperture and a thickness in the range of from about 0.0625 to 0.125 inches. The overall size of the washer comprising the shock mounting pad 160 also is set so as to be sufficient to cover the raised portion 128 in the top surface of the ignition device base 124. In general the shock mounting pad 160 is sized so as to be disposed between a portion of the top surface of the base unit 124 and a portion of the opposing surface of the support 140. It also is within the scope of the present invention for the shock mounting pad 160 to be of any size sufficient to at least allow the shock mounting pad to perform its intended function as well as being sized up to and including covering a substantial portion to essentially all of, the top surface of the base 124.

Figure 2:
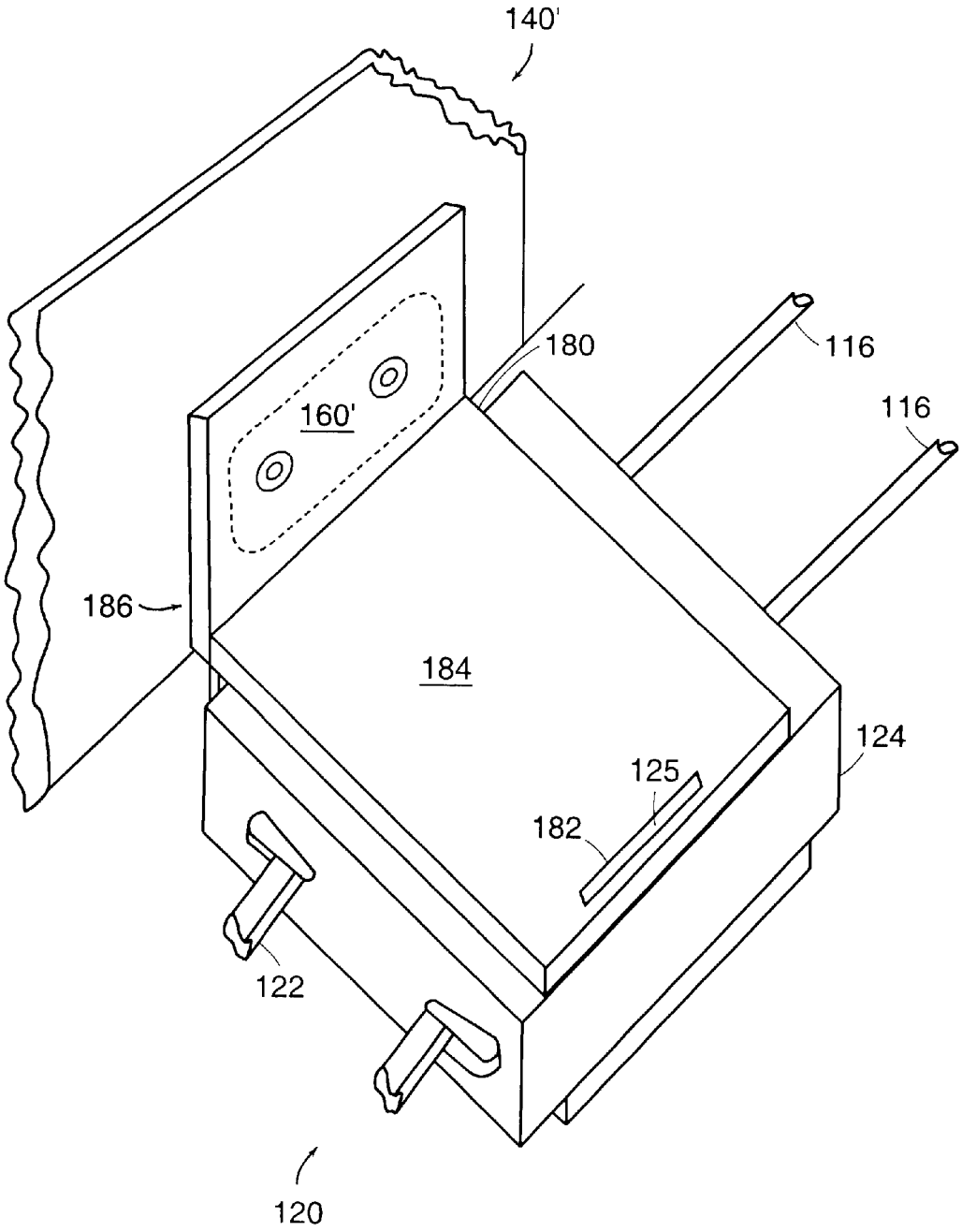
FIG. 2 is a perspective view of another exemplary ignition device without the element for clarity, that is secured to a support in accordance with the present invention.

There is shown in FIG. 2 a perspective view of another exemplary ignition device 120, without a complete heating element 122 for clarity, that is secured in accordance with the present invention to a support 140 of a heating device 100 (FIG. 3) by an intermediate support bracket 180. The ignition device is similar to that described above in connection with the discussion of FIG. 1 except that the top surface of the base 124 further includes a surface artifact 125 that projects upwardly from the top surface. The surface artifact 125 is configured so as to mechanically engage an aperture 182 in the intermediate support bracket 180, thereby securing the ignition device 120 to the intermediate support bracket.

The intermediate support bracket 180 includes a U-shaped portion 184 in which is securably received the ignition device base 124 and a flat portion 186 that is mechanically interconnected to the U-shaped portion. One leg of the U-shaped portion includes the aperture 182 that mechanically engages the top surface artifact 125. The flat portion 186 includes a plurality of through apertures by which the intermediate support bracket 180 is secured to the support 140, thereby also securing the ignition device 120 to the support. The mechanism for securing the intermediate support 180 to the support 140 shall be any of a number of securing mechanisms as discussed with more particularity in the discussion for FIG. 1, to which reference should be made.

A shock mounting pad 160' is disposed between a back surface of the flat portion 186 and an opposing surface of the support 140', which pad is configured and arranged so as to make the ignition device 120 more resistant to external loads, such as external impact loads, occurring during manufacturing, shipping and handling or during installation of the heating device.

The efficacy of the shock mounting pad 160, 160', related methods and appliances and heating apparatuses embodying such a shock mounting pad to make an ignition device 120 more resistant to external loads, in particular external impact loads, can be seen with reference to the following examples.

EXAMPLE 1

An ignition device 120 such as that shown in FIG. 1 is mechanically secured to a test block, representative of a support member, and an impact load is applied to the test block. The ignition device 120 was appropriately secured to the test block in one of two positions so that the load applied to the test block is applied to the ignition device in one of a horizontal and vertical direction. A multiplicity of the same type of ignition devices are successively tested so as to arrive at an average unitless value representative of the applied load causing a failure in each of the horizontal and vertical directions with and without a shock mounting pad.

One set of tests are performed using a multiplicity of ignition devices in which a 1/16 inch thick ceramic fiber pad in the form of a ½ inch diameter washer with a ⅛ inch through aperture is disposed between the ignition device base and the test block similar to that shown in FIG. 1. Another set of tests are performed using a multiplicity of ignition devices in which a ⅛ inch thick ceramic fiber pad in the form of a ½ inch diameter washer with a ⅛ inch through aperture is disposed between the ignition device base and the test block. For comparison purposes, a multiplicity of ignition devices are successively and directly secured to the test block (i.e., without a shock mounting pad). The results of these tests are provided in Table 1.

TABLE 1

| Test Direction | 1/16 Washer | ⅛ Washer | No Washer |
|---|---|---|---|
| Horizontal | 29.4 | 35.4 | 10.6 |
| Vertical | 34.8 | 34.2 | 12.2 |

EXAMPLE 2

In addition to testing an ignition device similar to that shown in FIG. 1, a 'N' block furnace style of igniter is mechanically secured to the test block, and an impact load is applied to the test block. The 'N' block furnace style igniter is appropriately secured to the test block in one of two positions so that the load being applied to the test block is applied to the 'N' block furnace style igniter in one of a horizontal and vertical direction. A multiplicity of the same type of igniters are successively tested so as to arrive at an average unitless value representative of the applied load causing a failure in each of the horizontal and vertical directions with and without a shock mounting pad.

One set of tests are performed using a multiplicity of 'N' block furnace style igniters in which a 1/16 inch thick ceramic fiber pad in the form of a ½ inch diameter washer with a ⅛ inch through aperture is disposed between the ignition device base and the test block similar to that shown in FIG. 1. Another set of tests are performed using a multiplicity of 'N' block style furnace igniters in which a ⅛ inch thick ceramic fiber pad in the form of a ½ inch diameter washer with a ⅛ inch through aperture is disposed between the ignition device base and the test block. For comparison purposes, a multiplicity of 'N' block furnace style igniters are successively and directly secured to the test block (i.e., without a shock mounting pad). The results of these tests are provided in Table 2.

TABLE 2

| Test Direction | 1/16 Washer | 1/8 Washer | No Washer |
|---|---|---|---|
| Horizontal | 34.6 | 39.6 | 10.6 |
| Vertical | 37.0 | 42.0 | 17.8 |

EXAMPLE 3

An ignition device 120 such as that shown in FIG. 1 is mechanically secured to a test block, representative of a support member, and an impact load is applied to the test block. The ignition device 120 is appropriately secured to the test block so that the load being applied to the test block is applied to the ignition device in the horizontal direction. A multiplicity of the same type of ignition devices are successively tested so as to arrive at an average unitless value representative of the applied load causing a failure in the horizontal direction with and without a shock mounting pad.

A set of tests is performed using a multiplicity of ignition devices in which a silicone foam pad, such as that manufactured by the Rogers Corporation under the name Poron®, approximately 1/16" (0.625) inches thick and having a density of about 24 lb./ft$^3$ is disposed between the ignition device base and the test block similar to that shown in FIG. 1. For comparison purposes, a multiplicity of ignition devices are successively and directly secured to the test block (i.e., without a shock mounting pad). The results of these tests are provided in Table 3.

TABLE 3

| Test Direction | With Pad | No Washer |
|---|---|---|
| Horizontal | 16.0 | 10.2 |

EXAMPLE 4

An ignition device 120 such as that shown in FIG. 1 is mechanically secured to a test block, representative of a support member, and an impact load is applied to the test block. The ignition device 120 was appropriately secured to the test block so that the load being applied to the test block is applied to the ignition device in the horizontal direction. A multiplicity of the same type of ignition devices are successively tested so as to arrive at an average unitless value representative of the applied load causing a failure in the horizontal direction with and without a shock mounting pad.

A set of tests are performed using a multiplicity of ignition devices in which a pad of a fiberglass insulation about 0.030 inches thick is disposed between the ignition device base and the test block similar to that shown in FIG. 1. The fiberglass insulation material is equivalent to that used for Exflex 1500 fiberglass insulation manufactured by Bentley-Harris. For comparison purposes, a multiplicity of ignition devices are successively and directly secured to the test block (i.e., without a shock mounting pad). The results of these tests are provided in Table 4.

TABLE 4

| Test Direction | Foam Pad | No Washer |
|---|---|---|
| Horizontal | 44.8 | 24.5 |

Now referring to FIG. 3, there is shown a simplified schematic view of a heating device 100, comprising one of an appliance or a heating apparatus, having an ignition source mounted to a support 140 (FIG. 1) in accordance with the methodology and devices of the present invention. The heating device 100 being illustrated is described hereinafter as being used with a gaseous hydrocarbon (such as natural gas, propane) as the material to be combusted therein to produce the heat energy. This shall not be construed as a limitation as the materials used for combustion are not limited to gaseous hydrocarbons but also include combustible liquid hydrocarbons and other gases (e.g., hydrogen) and liquids that continuously combust once they are ignited.

Such a heating device includes an ignition device 120, a burner tube 104, control circuitry 106, a fuel admission valve 108 and a power switch 110. The control circuitry 106 is electrically interconnected to the fuel admission valve 108 and the power switch 110 so as each can be selectively operated to produce heat energy as hereinafter described. The fuel admission valve 108 is fluidly interconnected using piping or tubing to a source 2 of a combustible material as the fuel for the heating device 100. In the illustrated embodiment, the piping or tubing is interconnected to a source of a gaseous hydrocarbon such as natural gas or propane. The fuel source can be one of an external tank or an underground natural gas piping system as is known to those skilled in the art.

The power switch 110 is electrically interconnected to a source of electrical power 4 and is electrically interconnected to the ignition device 120 via lines 116. The power source 4 generally has sufficient capacity to heat-up the heating element 122 of the ignition device 120 to the temperature required for ignition of the combustible mixture. The electrical power source 4 is any of a number of sources of electrical power known to those skilled in the art. In an exemplary embodiment, the electrical power source 4 is the electrical wiring of the building or structure in which is located the heating device 100, which electrical wiring is interconnected via a fuse box or the equivalent to the electrical distribution system of an electrical utility.

The control circuitry 106 is electrical interconnected to an external switch device 190 that provides the appropriate signals to the control circuitry for appropriate operation of the heating device 100. For example, if the heating device 100 is a furnace to heat a building structure or a hot water heater then the external switch device 190 is a thermostat as is known to those skilled in the art that senses a bulk temperature within the building structure or the hot water in the tank. Based on the sensed temperatures the thermostat outputs signals to the control circuitry 106 to turn the furnace or hot water heater on and off. If the heating device 100 is a heating appliance such as a stove, then the external switch device 190 typically is a rheostat type of switch. This type of switch outputs signals to the control device by which a user can turn the heating device 100 (e.g. stove burner, oven) on and off and also regulate or adjust the amount of heat energy to be developed by the heating device.

In use, the control circuitry 106 receives a signal from the eternal switch device 190 calling for the heating device 100 (e.g., stove burner, oven, hot water heater, furnace, etc) to be turned on. In response to such a signal, the control circuitry 106 actuates the power switch 110 thereby causing electricity to flow through the heating element 122 of the ignition heating device 120 to heat the heating element to the desired temperatures for causing a fuel/air mixture to ignite. After the heating element 122 is heated to the desired temperature, the control circuitry 106 actuates the fuel admission valve 108 so that fuel flows through the burner tube 104 to the heating element 122. As is known in the art, air is mixed with the fuel that is presented to the heating element 122 so that a combustible mixture is thereby created and ignited by the heating element. This ignited fuel/air mixture is passed to the combustion area 114 so that useable heat energy can be extracted and used for the intended purpose of the heating device (e.g., to heat food or water). Although a single burner tube 104 is illustrated, and as is known to those skilled in the art, the heating device 100 can be configured with a plurality or a multiplicity or more of burner tubes to generate a desired heat output and with one or more fuel admission valves 108. Typically, however, one of the plurality or multiplicity or more of burner tubes is arranged with an ignition device 120.

A sensor 112 is typically located proximal the heating element 122 to sense the temperature of the heating element and/or the temperature of the area in which the fuel/air mixture is being ignited by the heating element. This sensor 112 is interconnected to the control circuitry 106 so that if the sensor does not output, for example, a signal to the control circuitry indicating the safe and continuous ignition of the fuel/air mixture within a preset period of time, the control circuitry shuts the fuel admission valve 108. If the sensor 112 is configured to sense the preheat temperature of the heating element 122, then if the sensor does not output a signal to the control circuitry 106 indicating that the heating element is heated to the desired ignition temperature within a preset period of time, the control circuitry does not open the fuel admission valve 108.

When the heating function is completed, the control circuitry 106 again receives a signal from the external switch device 190 calling for the heating device to be turned off. In response to such a signal, the control circuitry 106 closes the fuel admission valve 108 to cut off the flow of fuel, thereby stopping the combustion process.

Although a preferred embodiment of the invention has been described using specific terms, such description is for illustrative purposes only, and it is to be understood that changes and variations may be made without departing from the spirit or scope of the following claims.

What is claimed is:

1. A method for securing an ignition device to an ignition device support member of a heating apparatus comprising the step of:

disposing a shock mounting pad between at least a portion of a surface of the ignition device and at last a portion of a surface of the support member, said surfaces respectively of the ignition device and the support member being opposed to each other at a location where the ignition device is to be secured to the support member, wherein the shock mounting pad is secured between said opposing surfaces respectively of the ignition device and the support member by a securing mechanism that secures the ignition device to the support member and is configured so as to reduce external loads to the ignition device when the shock mounting pad is so disposed there between; and wherein the shock mounting pad is a substantially planar member disposed about the securing mechanism.

2. The method according to claim 1, wherein the shock mounting pad is configured so as to reduce external loads being applied in one of directions transverse to a long axis of a heating element of the ignition device.

3. The method according to claim 1, wherein the external loads being particularly reduced are external impact loads.

4. The method according to claim 1, wherein the shock mounting pad is made of a material having a thickness and firmness so as to be capable of reducing external loads being applied in one of a horizontal or vertical direction with respect to a long axis of a heating element forming a part of the ignition device.

5. The method according to claim 1, wherein the shock mounting pad is made of a material having a thickness and firmness such that when the shock mounting pad is disposed between said opposing surfaces respectively of the ignition device and the support member, the resultant structure is more resistant to applied external loads than a case in which the ignition device is secured without a shock mounting pad.

6. The method according to claim 5, wherein the shock mounting pad is such that the resultant structure resists an external impact load one of at least about 50% larger on average or at least about 2 times larger on average than an impact load causing a failure in the case where the ignition device is secured without a shock mounting pad.

7. The method according to claim 5, wherein the shock mounting pad is such that the resultant structure resists an external impact load in the range of from about 1¾ to about 3 times larger on average than an impact load causing a failure in the case where the ignition device is secured without a shock mounting pad.

8. The method according to claim 1, wherein the shock mounting pad is configured so as to have a thickness of one of at least about 0.030 inches or at least about 0.0625 inches.

9. The method according to claim 1, wherein the shock mounting pad is configured so as to have a thickness in the range of from about 0.030 inches to about 0.125 inches.

10. The method according to claim 1, wherein the shock mounting pad is made from a material that is one of ceramic fibers, fiberglass, viton rubber, rubber, metal, foam plastics and silicone foam.

11. The method according to claim 1, wherein the ignition device includes a mounting mechanism and wherein said step of disposing includes disposing the shock mounting pad between at least a portion of a surface of the mounting mechanism and the at least a portion of the surface of the support member, where said surfaces respectively of the mounting mechanism and the support member are opposed to each other where the mounting mechanism is secured to the support member.

12. A method for improving the shock resistance of an ignition device to be attached to an ignition device support member of a heating apparatus comprising the steps of:

providing a shock mounting pad that is substantially planar;

disposing the shock mounting pad between at least a portion of a surface of the ignition device and at least a portion of a surface of the support member, said surfaces respectively of the ignition device and the support member being opposed to each other at a location where the ignition device is to be secured to the support member;

securing the ignition device and the shock mounting pad to the support member using a securing mechanism such that the provided shock mounting pad is securedly disposed between said opposing surfaces and about the securing mechanism; and wherein the shock mounting pad being provided is configured to reduce external impact loads to the ignition device when the shock mounting pad is so disposed between said opposing surfaces.

13. The method according to claim 12, wherein the shock mounting pad being provided is configured so as to reduce external impact loads being applied in one of directions transverse to a long axis of a heating element of the ignition device.

14. The method according to claim 12, wherein the shock mounting pad being provided is of a material having a thickness and firmness so as to be capable of reducing external impact loads being applied in one of a horizontal or vertical direction with respect to a long axis of a heating element forming a part of the ignition device.

15. The method according to claim 12, wherein the shock mounting pad being provided is of a material having a thickness and firmness such that when the shock mounting pad is disposed between said opposing surfaces respectively of the ignition device and the support member, the resultant structure is more resistant to applied external impact loads than a case in which the ignition device is secured without the shock mounting pad.

16. The method according to claim 15, wherein the shock mounting pad being provided is such that the resultant structure resists an external impact load one of at least about 50% larger on average or at least about 2 times larger on average than an impact load causing a failure in the case where the ignition device is secured without a shock mounting pad.

17. The method according to claim 15, wherein the shock mounting pad being provided is such that the resultant structure resists an external impact load in the range of from about 1¾ to about 3 times larger on average than an impact load causing a failure in the case where the ignition device is secured without a shock mounting pad.

18. The method according to claim 12, wherein the shock mounting pad being provided has a thickness of one of at least about 0.030 inches or at least about 0.0625 inches.

19. The method according to claim 12, wherein the shock mounting pad being provided has a thickness in the range of from about 0.030 inches to about 0.125 inches.

20. The method according to claim 12, wherein the shock mounting pad being provided is made from a material that is one of ceramic fibers, fiberglass, viton rubber, rubber, metal, foam plastics and silicone foam.

21. The method according to claim 12 where the ignition device further includes a mounting bracket and wherein said step of disposing includes disposing the shock mounting pad between a surface of the mounting bracket and a surface of the support member, where said surfaces respectively of the mounting bracket and the support member are opposed to each other where the mounting bracket is to be secured to the support member and wherein said step of securing includes securing the mounting bracket to the support member.

22. A shock mounting device for an ignition device secured to an ignition device support of a heating apparatus using a securing mechanism, said shock mounting device comprising:

a pad being substantially planar and being configured so as to be disposed between opposing surfaces respectively of the ignition device support and the ignition device at a location where the ignition device is to be secured to the support; and wherein the pad is configured and arranged so as to reduce communication of external impact loads to the ignition device and so that when the pad is disposed between said opposing surfaces respectively of the ignition device and the support, the resultant structure is more resistant to applied external loads than a case in which the ignition device is secured without the pad; and wherein the shock mounting pad is configured and arranged so as to be disposed about the securing mechanism.

23. The shock mounting device according to claim 22, wherein the pad is configured so as to reduce communication of external loads being applied in one of directions transverse to a long axis of a heating element of the ignition device.

24. The shock mounting device according to claim 22, wherein the external loads being particularly reduced are external impact loads.

25. The shock mounting device according to claim 22, wherein the pad has a thickness and firmness so as to be capable of reducing the communication of external loads being applied in one of a horizontal or vertical direction with respect to a long axis of a heating element forming a part of the ignition device.

26. The shock mounting device according to claim 22, wherein the pad has a thickness and firmness such that when the pad is disposed between the ignition device and the support, the resultant structure is more resistant to applied external loads than a case in which the ignition device is secured without the pad.

27. The shock mounting device according to claim 26, wherein the pad thickness and firmness is such that the resultant structure resists an external impact load one of at least about 50% larger on average or at least about 2 times larger on average than an impact load causing a failure in the case where the ignition device is secured without the pad.

28. The shock mounting device according to claim 26, wherein the pad thickness and firmness is such that the resultant structure resists an external impact load in the range of from about 1¾ to about 3 times larger on average than an impact load causing a failure in the case where the ignition device is secured without the pad.

29. The shock mounting device according to claim 22, wherein the pad has a thickness of one of at least about 0.030 inches or at least about 0.0625 inches.

30. The shock mounting device according to claim 22, wherein the pad has a thickness in the range of from about 0.030 inches to about 0.125 inches.

31. The shock mounting device according to claim 22, wherein the pad is made from one of ceramic fibers, fiberglass, viton rubber, rubber, metal, foam plastics and silicone foam.

32. A heat energy generating apparatus comprising:

an ignition device that ignites a fuel, which ignited fuel generates heat energy;

a support;

a securing mechanism that secures the ignition device to the support;

a shock mounting device including a pad, the pad being configured so as to be disposed between a surface of the support and at least a part of a surface of the ignition device, said surfaces respectively of the ignition device and the support being opposed to each other at a location where the ignition device is to be secured to the support by the securing mechanism;

wherein said pad is secured between said opposing surfaces respectively of the ignition device and the support by the securing mechanism and disposed about the securing mechanism;

wherein the pad is a substantially planar member and is configured so as to reduce communication of external impact loads to the ignition device when the pad is disposed between the ignition device and the support.

33. A method for securing an ignition device to an ignition device support member of a heating apparatus comprising the step of:

providing a shock mounting pad that is substantially planar;

disposing the shock mounting pad between a surface of the ignition device and a surface of the support member, said surfaces respectively of the ignition device and the support member being opposed to each other at a location where the ignition device is to be secured to the support member, securing the ignition device and the shock mounting pad to the support member using a securing mechanism and so that the shock mounting pad is interposed between said opposing surfaces respectively of the ignition device and the support member;

wherein the provided shock mounting pad is made of a material having a thickness and firmness such that when the shock mounting pad is disposed between said opposing surfaces respectively of the ignition device and the support member, the resultant structure is more resistant to applied external loads than a case in which the ignition device is secured without a shock mounting pad; and wherein the provided shock mounting pad and the securing mechanism are configured and arranged so the shock mounting pad is disposed about the securing mechanism when the securing mechanism is secured to the support member.

34. The method according to claim 33, where the provided shock mounting pad is configured with a through aperture and wherein said step of securing includes passing a portion of the securing mechanism through the pad aperture.

35. The method according to claim 33, wherein an end portion of the securing mechanism is configured to pierce and pass through the shock mounting pad and wherein said step of securing includes piercing the shock mounting pad with the securing mechanism so that a portion thereof passes through the pad.

36. The method of claim 33, wherein the securing mechanism is a mechanical fastener.

37. The method of claim 33, further comprising the step of applying an adhesive material to a surface of the shock mounting pad and wherein said step of disposing includes adhesively securing the shock mounting pad to one of said opposing surfaces respectively of the ignition device and the support member.

38. A heat energy generating apparatus comprising:

an ignition device that ignites a fuel, which ignited fuel generates heat energy;

a support;

a securing mechanism that secures the ignition device to the support;

a shock mounting device including a pad that is substantially planar, the pad being configured so as to be disposed between a surface of the support and at least a part of a surface of the ignition device, said surfaces respectively of the ignition device and the support being opposed to each other at a location where the ignition device is to be secured to the support; and wherein the pad being is made of a material having a thickness and firmness such that when the pad is disposed between said opposing surfaces respectively of the ignition device and the support, the resultant structure is more resistant to applied external loads than a case in which the ignition device is secured without a pad; and wherein the pad and the securing mechanism are configured and arranged so the shock mounting pad is disposed about the securing mechanism when the securing mechanism is secured to the support.

39. The heat generating apparatus of claim 38, wherein the pad is configured with a through aperture and wherein the pad and the securing mechanism are arranged so a portion of the securing mechanism passes through the pad aperture.

40. The heat generating apparatus of claim 38, wherein an end portion of the securing mechanism is configured to pierce and pass through the pad, whereby when the ignition device is secured to the support, the securing mechanism pierces the pad so that a portion thereof passes through the pad.

41. The heat generating apparatus of claim 38, wherein the securing mechanism is a mechanical fastener.

42. The heat generating apparatus of claim 38, wherein the pad includes an adhesive layer that is applied to a surface of the pad, whereby the pad can be adhesively secured to one of said opposing surfaces respectively of the ignition device and the support to facilitate securing the pad therebetween.

* * * * *